United States Patent [19]

Sörensen et al.

[11] 4,268,929

[45] May 26, 1981

[54] METHOD AND APPARATUS FOR CLEANING RUGS AND MATS

[75] Inventors: Finn L. Sörensen; Robert Neubert, both of Hornslet, Denmark

[73] Assignee: Clean-Tex A/S, Mörke, Denmark

[21] Appl. No.: 118,090

[22] Filed: Feb. 4, 1980

[51] Int. Cl.[3] ..... D06B 3/12; D06B 3/20; B08B 3/10

[52] U.S. Cl. ..... 8/151; 15/306 A; 15/345; 15/404; 26/2 R; 34/191; 68/3 SS; 68/13 R; 68/184; 134/15; 134/64 R; 134/196

[58] Field of Search ..... 8/151; 68/3 SS, 5 D, 68/5 E, 13 R, 18 F, 20, 158, 175, 190, 205 R, 207, 9, 27, 184; 134/9, 15, 64 R, 122 R, 196; 26/2 R; 28/159; 15/306 A, 306 B, 308, 345, 404; 34/191

[56] References Cited

U.S. PATENT DOCUMENTS

| | | | |
|---|---|---|---|
| 2,515,223 | 7/1950 | Hollick | 15/306 A X |
| 2,699,592 | 1/1955 | Newnam | 68/3 SS X |
| 3,420,710 | 1/1969 | Wollman | 134/15 X |
| 4,141,231 | 2/1979 | Kudlich | 68/205 R |

FOREIGN PATENT DOCUMENTS

| | | | |
|---|---|---|---|
| 865888 | 2/1953 | Fed. Rep. of Germany | 26/2 R |
| 39959 | 11/1971 | Japan | 26/2 R |
| 1380071 | 1/1975 | United Kingdom | 26/2 R |

*Primary Examiner*—Philip R. Coe
*Attorney, Agent, or Firm*—Craig & Antonelli

[57] ABSTRACT

A method and a washing machine for cleaning of rugs or mats having a nap or pile side, whereby the rugs or mats are successively conveyed along a conveying path and are exposed to cleaning operations, at least one of which is a pulsating operation, during which each mat or rug is also exposed to a relatively abrupt change of direction of conveyance in order to open an area of pile at the pile side of the mat or rug. The change of direction preferably has a radius of curvature in a range between 1.5 cm and 15 cm during an angular change of direction of approximately 180 degrees. The cleaning fluid used in one operation is for saving of energy preferably used also in another earlier cleaning operation on the mats or rugs, possibly after having been conditioned for this earlier operation.

11 Claims, 8 Drawing Figures

METHOD AND APPARATUS FOR CLEANING RUGS AND MATS

Figure 1:
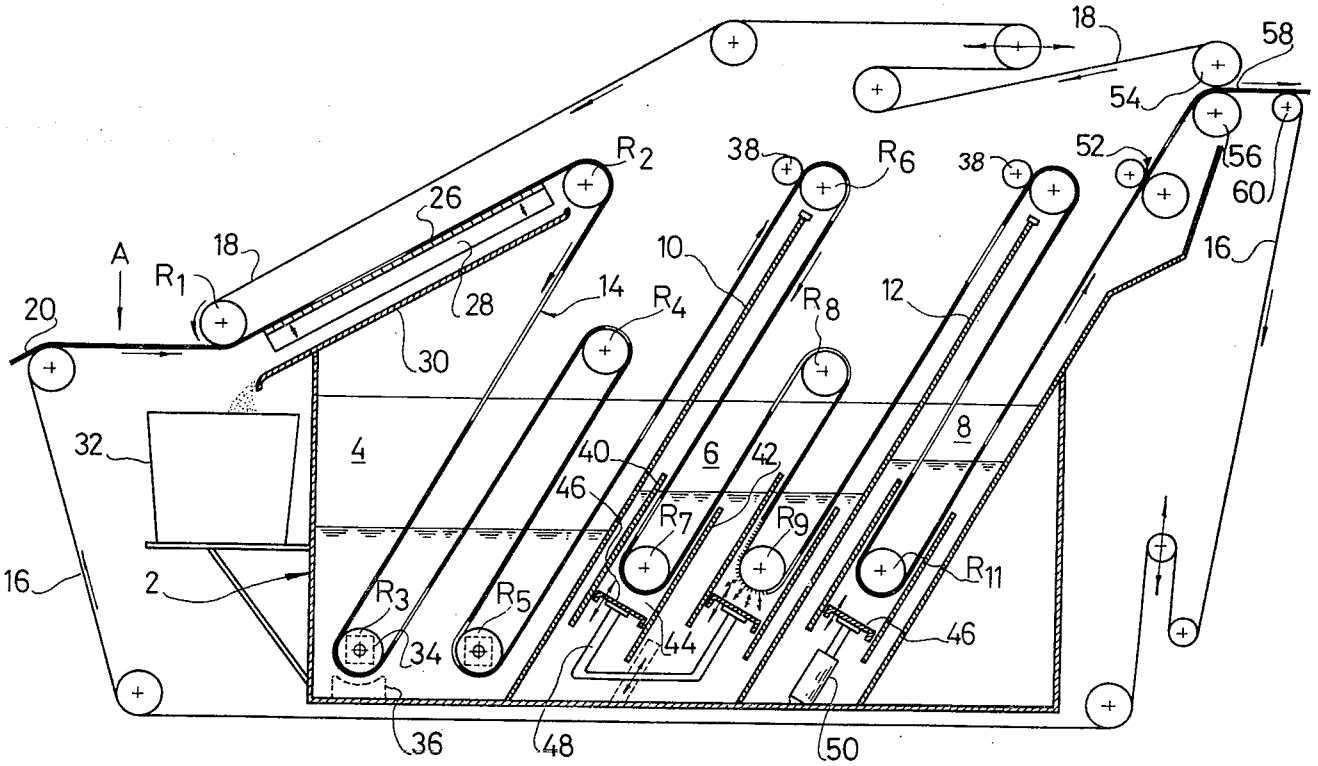

This invention relates to cleaning of rugs and mats and more particularly to methods and means for industrial mat cleaning such as required in connection with commercial mat maintenance services. In all types of enterprises it becomes increasingly popular to make use of door mats of the soft dust absorbing type which require cleaning or washing regularly, and normally these mats and hired from laundries or other firms specialized in running a mat exchange and washing service. Normally the mats are made with a latex backing for binding the soft nap, and when the washing is carried out in conventional washing machines the ideal washing capacity is adversely affected by the fact that the backings of the mat charge do not really need to be washed, so the integral presence of the backing of the mats in the washing drum constitutes a capacity reduction.

It has been endeavoured, therefore, to design so-called "flat washers", i.e. washing machines in which the mats are guided through a washing zone in a well defined manner, whereby means may be arranged for actively cleaning the mats specifically from the nap side thereof. In this connection it should be emphasized that the said type of rugs and mats is particularly difficult to wash, because of the tight backing which does not allow for water or any other cleaning fluid to penetrate the article to be washed. On the other hand, once the mats are moved through a washing zone in a well defined manner it is easy to provide for nap treating means such as rotary brushes designed to effect a positive cleaning action on the nap side of the mats.

However, though previous attempts to treat the mat nap sides with mechanical cleaning means such as the said rotary brushes have had some success in connection with special types of mats, they have not been successful as far as the preferred mat types are concerned, these being provided with a nap mainly consisting of cotton fibres or a similar soft material, and generally a nap of this kind get compacted and even damaged when subjected to any hard mechanical treatment including high pressure water jets and the like.

It is the purpose of this invention to provide for methods and means enabling rugs and mats of the type in question to be effectively cleaned in a gently manner and without the nap being caused to be compacted.

Accordingly the invention concerns a method for cleaning of rugs or mats having a nap or pile on one side, preferably for washable dust control mats, whereby the mats are successively conveyed along a conveying path and are exposed to different cleaning operations in a number of stations, the method of which is characterized in that the mats in at least one of the stations are exposed to a relatively abrupt change of direction of conveyance in order to open an area of pile at the pile side of the mat, and that the opened pile area is exposed to a pulsating fluid pressure, whereby a widespread pumping and suction effect is obtained throughout the opened nap area, and in this manner it seems possible to achieve a high washing efficiency without the nap being damaged or compacted.

The change of direction in order to open said pile area to be exposed for the pulsating fluid pressure may be carried out by conveying the mats through a path having a radius of curvature between 0.6 and 6 inches, preferably between 1 and 2 inches.

The path of this curvature may of course not give rise to a high friction which in turn will expose the mats for a high degree of wear. However, when said path is provided with guide surfaces having low friction to the back of the mats this problem is eliminated. The low friction may be obtained by using a roller, the diameter of which is double the said radius of curvature, especially in case of rubber backed mats.

The pulsating fluid may be gaseous by dry treatments such as pulsating dust removing, drying, spray impregnating, heating, etc. or liquid in case of wet treatments such as prewashing, washing, impregnating, rinsing, etc. in the vessels.

An aspect of the invention is therefore also a washing machine for cleaning rugs or mats having a nap or pile side, e.g. washable dust control mats, which machine comprises a mat treatment vessel and conveying means to convey mats successively along a conveying path through the treatment vessel, in the lower part of which is mounted a low friction, transversely of the conveying path extending pile opener member, preferably a pile opener roller, the function of which is to open the pile by a relatively abrupt change in the direction of conveying, the conveying path extending along a lower part of the pile opener, the curvature of said lower part transversely of its longitudinal direction being large enough to open the piles widely, e.g. the curvature being at least 3 foot$^{-1}$, and in which vessel a fluid pulsating means is mounted below or by side of the pile opener.

According to an energy saving aspect of the invention the liquids used travel through the wet treatment vessels in opposite succession of the travel of mats through the same vessels. Thereby water and heating energy can be saved in this washing machine which makes the use of it even more attractive. The cold rinsing water, e.g., enters the rinsing vessel, possibly through a pulsating device, and rinses and cools the hot mats. The hot used rinsing water leaves the rinsing vessel and enters a washing vessel, washing agent and possible further heat being added to the washing process in the washing vessel. The washing water is then transferred to a prewashing vessel and used herein before it leaves this vessel either for regeneration or drain off. Because of the wide opened pile area of the mats the treatment fluids contact the bottom part of the pile and the base material of the mats very intimately and consequently both cleaning, washing and heat transfer is promoted in a hitherto unknown measure.

The gaseous fluid e.g. air used for drying the mats can also be used in an upstream placed dry vessel for preheating and premoistening the mats before the washing step, and this used demoistened air can be reused in a pulsating device for dust removing in a further upstream placed dry vessel. If only the heat energy is to be saved all outlets of fluids from the vessels may be connected to a heat exchanger, from which fresh heated fluids may be achieved for the different vessels.

According to another aspect of the invention mats are successively subjected to a dry vibration or beating treatment before they are submerged in a liquid containing vessel such as a washing tank, whereby coarse and loose dust may be removed before the wet treatment is initiated.

Figure 2:
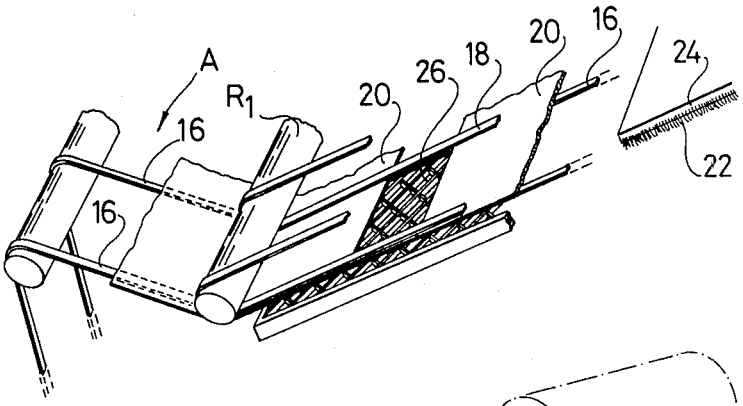
Figure 3:
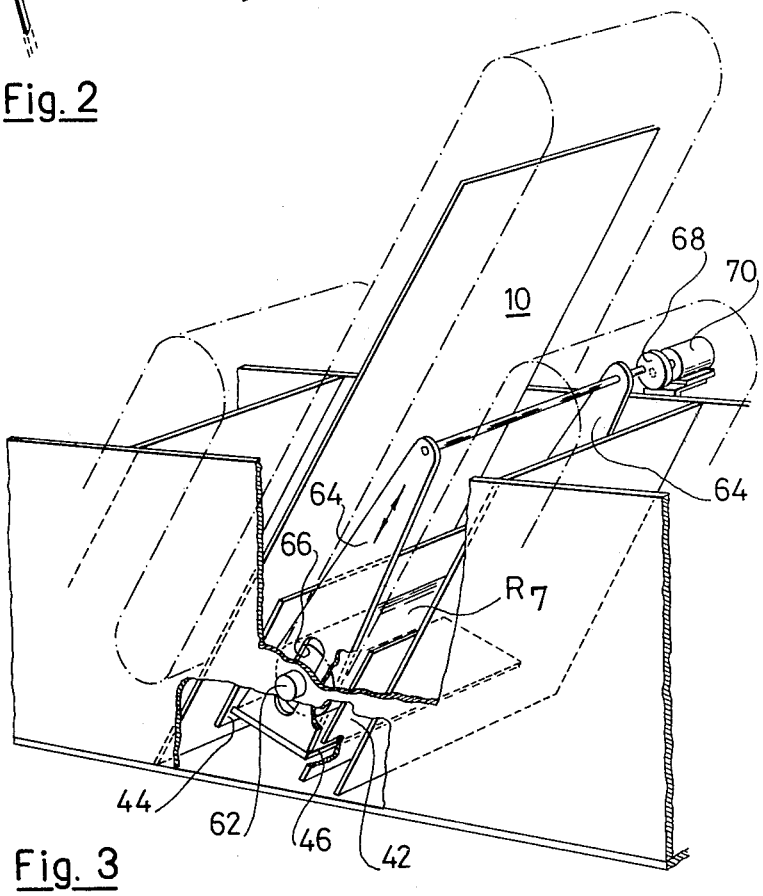
Figure 4:
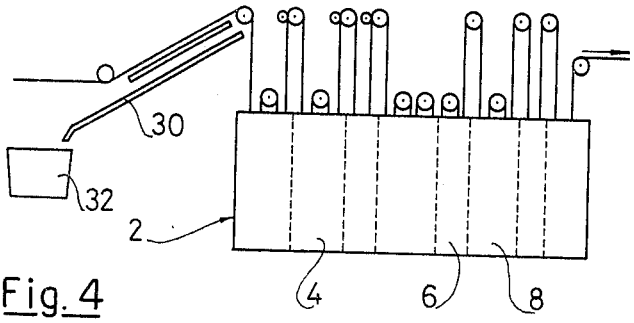
Figure 5:
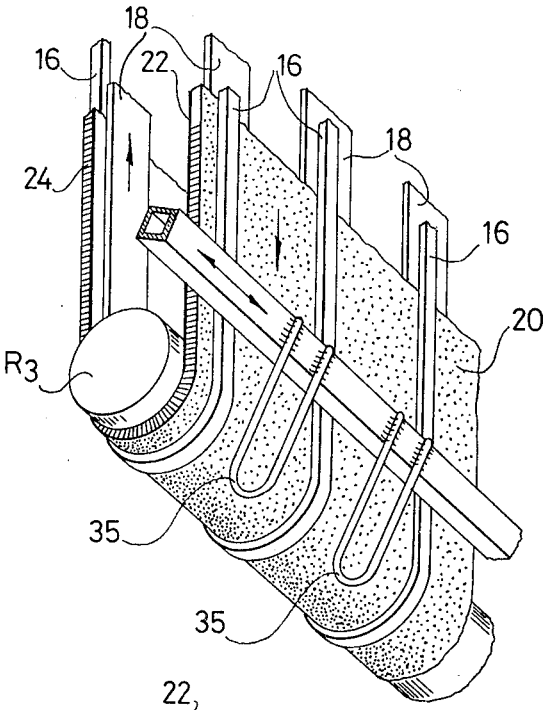
Figure 7:
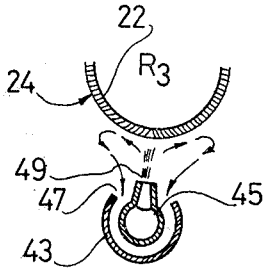
Figure 6:
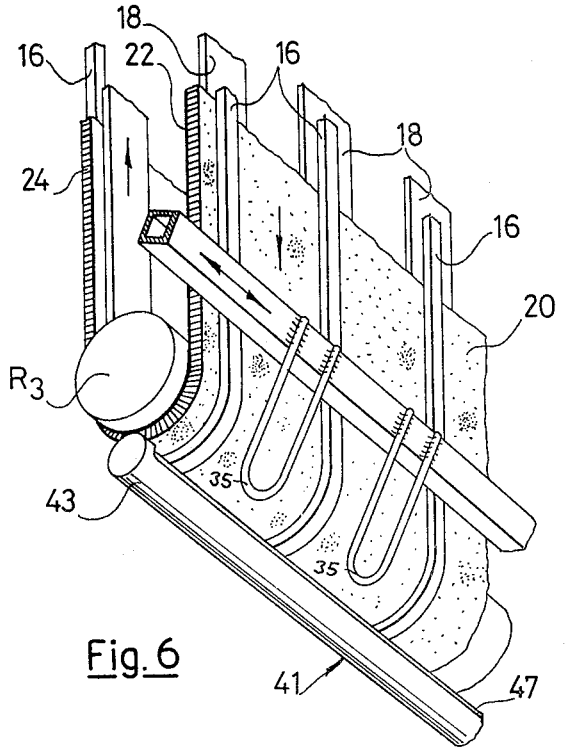
Figure 8:
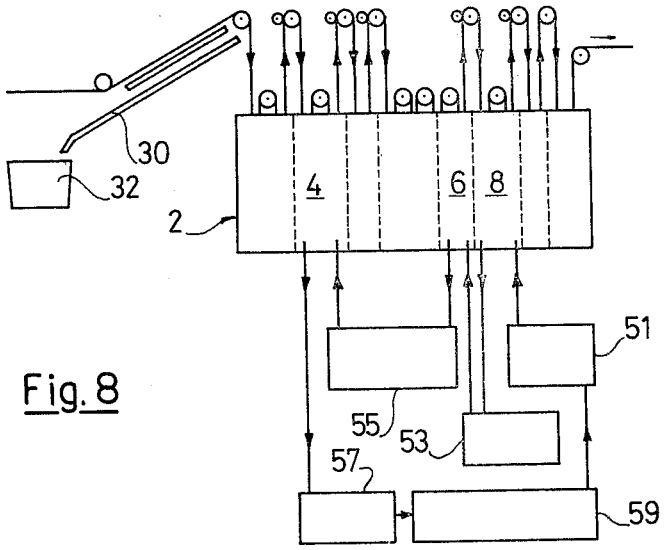

These and further aspects and advantages of the invention will appear from the following, more detailed description of the invention, reference being made—by way of example—to the accompanying drawing, in which:

FIG. 1 is a schematic side view of a washing apparatus according to the invention, FIG. 2 is a fragmentary perspective view of the inlet end thereof, FIG. 3 is a fragmentary perspective view, partly in section, of a modification of one of the washing stations of this apparatus, FIG. 4 is a schematic side view of a preferred design of the apparatus, FIG. 5 is a fragmentary perspective view showing from below a pile opener roller equipped with a set of transversely rubbing fingers inside a dry or open vessel, FIG. 6 is a view similar to FIG. 5, but where a drying means or a combined air pulsator and dust exhausting means is placed below the pile opener roller, FIG. 7 is a cross sectional view of the drying means or the combinated air pulsator and dust exhausting means shown in FIG. 6, and FIG. 8 is a schematic view and diagram similar to FIG. 4 showing the downstream mat transport and the upstream water transport when the water is reused in several vessels of the washing tank.

The washing apparatus shown in FIG. 1 comprises an open tank 2 divided into three individual washing vessels or compartments 4, 6 and 8 by means of two inclined and upwardly extended partition elements 10 and 12. A conveying means in the form of a double conveyor belt system 14 is guided by means of a number of transverse rollers R so as to be moved repeatedly down into and upwardly from the treatment fluids e.g. a washing liquid in the various tank compartments. The conveyor belt system 14 is composed of the upper run of a lower belt system 16 as laid together with the lower run of an upper belt system 18, these systems being successively juxtaposed adjacent the rear end of a feed-in station A, as also shown in FIG. 2, in which mats 20 may be laid onto a horizontal run of the lower belt system 16 and then be moved underneath a roller $R_1$, about which the belts of the upper belt system 18 are guided against the mat top side, whereafter the mats are conveyed further clamped between the opposed belts.

The mats 200 are laid on the belts 16 in the feeding station A so as to be oriented upside down, i.e. such that the nap or pile side 22 is carried on the belts 16 while the latex backing 24 constitutes the top side of the mat members.

The first run portion of the combined belt conveyor 14 is upwardly inclined, towards a roller $R_2$, and along this run portion the mats are caused to pass along the top side of a grate element 26 associated with dust beater or vibrator means 28 so as to be vibrated generally perpendicular to the plane of the mats, whereby, especially by the upstrokes of the grating 26, the coarse dust in the mat is beated out so as to fall through the grating 26 down to a chute 30 on which the coarse dust slides down to a receptable 32. The grating 26 and the vibrator means 28 may also be located in a trough connected to a vacuum source with a closed dust container.

From the roller $R_2$ the belt system 14 moves the mats down into either a further dust removing compartment (not shown) or into a prewashing compartment 4, in which the mats are submerged as they pass a pile opener member in form of a bottom roller $R_3$, about which the movement is turned 180°. The mats are then lifted up by passing an upper roller $R_4$, about which they are again sent into the compartment 4 to pass about another pile opener or bottom roller $R_5$. One of or both the rollers $R_3$ and $R_5$ may be associated with vibrator means 34 serving to vibrate the entire roller, whereby more dirt may be loosened from the nap, which passes the respective roller as the outermost layer of the mat, i.e. the nap is exposed to the surrounding liquid and the nap is caused to be expanded and to some degree "opened" as the mat backing 24 is passing and bent about the respective roller. Alternatively or additionally a pulsator or vibrator system 36 may be arranged just outside the said area in which the nap is "opened", whereby pressure waves and/or reciprocating fluidstreams in the water will intrude into the nap layer and contribute to loosening the dust even without the nap being materially touched. Even ultrasonic operation of the system 36 may be considered.

When leaving the last bottom roller $R_5$ in compartment 4 the belt conveyor 14 and therewith the pretreated mats 20 proceed upwardly along the inclined partition 10, with the mat nap sides located to the right, generally as the lowermost layer of the mats, such that water may drip off from the nap and be returned to the compartment 4 by running down the partition 10. By said inclination a good frictional contact between the mats and the conveyor is ensured. Topwise of the partition is arranged a roller $R_6$ serving to turn the conveyor for further movement down into the next compartment 6 and to cooperate with a pinching or wringer roller 38 to force practically all remaining water out of the mats before they proceed to the next compartment which may hold a different liquid.

The conveyor now proceeds to a first bottom roller $R_7$ in the next compartment 6 and then via an upper roller $R_8$ to a second bottom roller $R_9$, from which the conveyor leaves the compartment 6 in the same manner as it left the compartment 4 from the roller $R_5$.

Each of the rollers $R_7$ and $R_9$ is mounted in the space between two opposed, parallel plate members 40 and 42 extending between the side walls of the tank 2 parallel with the partition 10 and spaced from each other only slightly more than the exterior diameter of the respective roller including the belt conveyor 14, such that the mats pass closely along the interfacing sides of the plate members 40 and 42. These plate members are extended downwardly beyond the rollers $R_7$ and $R_9$ so as to define underneath each of the rollers a space 44 which is topwise practically closed by the respective roller. Inside the space 44 is provided pulsating means in form of a transverse plate element 46 mounted on a carrier structure 48 so as to be axially reciprocal in the space 44, the element 46 practically filling out the cross section of the space 44, and the carrier structure 48 being driven by any suitable means so as to reciprocate the plate elements 46 according to the arrows shown.

By the forced reciprocation of the plate element 46 in the space 44 the water (or cleansing liquid) underneath the respective roller $R_7$ or $R_9$ will be subjected to pronounced pressure oscillations amounting to a pumping-/suction effect on the "opened" nap, as illustrated by arrows in the detailed view at roller $R_9$ at the bottom of FIG. 1, and an effective washing action is hereby obtained even without the reciprocation taking place with any high frequency.

The compartment 8 is equipped in a similar manner, though with one roller $R_{11}$ only. The reciprocating plate member is shown driven by a hydraulic cylinder 50.

In practice it is preferred to let the washing machine comprise a number of compartments higher than the three shown in FIG. 1, for enabling the washing process to be optimized by differentiated treatments, but of course the detailed design will be a matter of choice in this respect.

When the conveyor leaves the last compartment of the tank it is passed through a pair of wringer rollers 52 and then through a pair of exit rollers 54 and 56, of which the upper roller 54 serves as a return roller for the belts 18, while the roller 56 guides the belts 16 into a horizontal run 58 with the washed mat 20 resting thereon, to an outermost return roller 60 for the lower belts 16. The mats overrunning the roller 60 may be received by another conveyor belt system and moved further into a drying and impregnating machine section, if desired. This drying and impregnating may of course also be performed in additional similar compartments of the present machine.

It appears from FIG. 1 that the bottom rollers $R_7$, $R_9$, and $R_{11}$ in the compartments 6 and 8 are located at a relatively high level in order to provide space for the underlying means for reciprocating the plate elements 46. The spaces underneath the lowermost position of the elements 46 are more or less dead spaces, and also for this reason it will be desirable to locate the said rollers and the plate elements 46 closer to the tank bottom and to mount the reciprocation driving means at the top of the tank or at least above the liquid level of the respective compartment, whereby special sealing problems will also be avoided.

In FIG. 3 is shown, by way of example, a driving system made according to this proposal. The roller R is rotatably mounted between bearings 62 secured to the opposed tank side walls, and the reciprocal plate element 46 is at both ends provided with upstanding bracket elements 64 projecting upwardly immediately inside the respective tank side walls and having an elongated slot 66 through which the shaft of the roller R passes between the roller end and the bearing 62. Thus, without being obstructed by the presence of the roller R the plate element 46 may be moved up and down by way of a corresponding movement of the bracket plates 64. Such movement is easy to effect at the top ends of the bracket plates, e.g. by hydraulic cylinders or as shown by means of an eccentric 68 driven by a gear motor 70 through a suitable parallel guiding system (not shown) for the two bracket members 64.

The effect of the water adjacent the "opened" nap portions being subjected to pumping/suction pressure fluctuations will be obtainable by means other than the reciprocated plate elements 46, e.g. by corresponding reciprocation of the rollers or the lower end portions of the transverse plate members 40, 42. If the plate elements 46 are fixed the pressure fluctuations may be obtained by a pipe connection to exterior means for providing such fluctuations. Such pipe connection may include a transverse perforated tube or channel extending through the space 44, and it will hereby be possible to introduce an amount of air giving rise to the nap being subjected to air bubbles which may increase the washing effect; similar bubbles could be introduced by the means 36 in compartment 4 of FIG. 1.

The cleaning effect, of course, irrespectively of the means used for the cleaning, will be generally improved the more the nap is "opened" by the passage of the rollers in the tank, and generally the degree of opening the nap will be higher the smaller the roller diameter is. A preferred range of diameters of the rollers serving as pile opener members is approximately from 1 to 12 inches when common known dust control mats are in question, a more preferred range being from 2 to 4 inches. With a high degree of opening it may even be considered to apply some gentle mechanical treatment to the nap, e.g. brushing by rotary brushes or use of pulsating or non-pulsating high pressure water jets, because such treatment will be less liable to cause compaction of the nap when effected while the nap is held widely open. On the other hand, at least with the use of the belt conveyor system as disclosed (and as well known per se) it should not be too small, for ensuring a reasonably long life of the belts.

The dust chute 30 may be replaced by a vacuum cleaner box having a mesh compartment (not shown) which compartment is dry and is arranged before the compartment 4. This further chamber has also an upper and a lower roller similar to the rollers of the wet compartments 4, 6 and 8. Below the lower roller $R_3$ as shown in FIG. 6 and 7 a pulsating set of air nozzles 49 on an air supply line 45 together with a vacuum cleaner box 43 transversely arranged in a unit 41 may be placed to remove remaining dust in the mats via suction opening 47 when the tufting of these is opened by passing the surface of the roller $R_3$. In as well the dry as in the wet compartment 4, 6 and 8 a set of rubbing fingers 35 may be arranged in contact with the tufted surface of a mat passing the lower rollers $R_3$ as shown in FIG. 5 and 6 and mechanically moved transversely of the feed direction of the mats i.e. longitudinally of the rollers to loosen dust before the mats pass the lower line of the lower rollers as also indicated at 35 adjacent roller $R_3$ in FIG. 1.

Instead of having inclined side walls 10, 12 these can be vertical as shown in FIG. 4. Consequently the runs of the conveyor belt system 14 is also arranged vertical between the rollers near the top of the washing apparatus and near the bottom of this. Thereby the length of the apparatus can be shorter.

To obtain savings of energy and water consumption a counterflow of water may be used, i.e. as shown in FIG. 8, where the water is supplied from water source 51 into the last wet compartment 8 for rinsing the mats and is thereby heated by the still hot mats. Then the water in water treatment device 53 is supplied with heat and washing agent before being supplied to the next compartment 6 and after having been used in the washing operation in compartment 6 the same water is supplied from water treatment device 55 to the prewashing compartment 4, possibly after having been supplied with further heat and washing preparation. From compartment 4 the used water may be drained-off or via water drain 57 supplied to water regeneration device 59, from where the regeneration water may be used again to the water supply 51.

What is claimed is:

1. A method for cleaning of rugs and mats having a nap or pile on one side, preferably for washable dust control mats, whereby the mats are successively conveyed along a conveying path and are exposed to different cleaning operations in a number of stations, characterized in that the mats in at least one of the stations are exposed to a relatively abrupt change of direction of conveyance in order to open an area of pile at the pile side of the mat, and that the opened pile area is exposed to a pulsating fluid pressure.

2. A method of claim 1, characterized in that the said change of direction is carried out by conveying the mats through a curvature having a radius between 1.5 and 15 cm, preferably by guiding the mats about a roller of a diameter between 2.5 and 5 cm.

3. A washing machine for cleaning rugs or mats having a nap or pile on one side thereof, e.g. washable dust control mats, the machine comprising a mat treatment vessel and guiding and conveying means to convey mat successively along a bandlike conveying path through the treatment vessel, characterized in that the guiding and conveying means are arranged so as to define a conveying path showing a relatively sharp bend at a predetermined treatment position in said vessel to effectively cause the nap or pile in the bent area to open or expand when it passes through said bend, said nap or pile in said bend being the radially outermost part or layer of the mat, and that a fluid pulsating means is arranged in the vessel operable to expose the area of the nap or pile thus opened or expanded to a fluid pulsation treatment.

4. A machine according to claim 3, characterized in that the bend of the conveying path is defined by a low friction, edge member or roller forming a pile opener member that extends transversely of and parallel to the bandlike conveying path, the edge member defining the bend and guiding the mat through an angle of approximately 180° with the opened pile area generally facing the bottom of the vessel and having a mat contacting surface of a cross-sectional curvature being at least 1 foot$^{-1}$.

5. A machine according to claim 4, characterized in that there is arranged a set of rubbing finger members for mechanically engaging the nap during a part of the mat movement about said pile opener member, preferably at an initial part of said movement, said finger members being reciprocally movable in the longitudinal direction of the pile opener member, for opening or expanding the nap in that direction.

6. A machine according to claim 4, characterized in that the fluid pulsating means comprises a piston arranged for reciprocal movement towards and away from the opened pile area and extending as a plate strip member parallel with the pile opener member.

7. A machine according to claim 6, characterized in that the piston member is mounted in the space between the pile opener member and the bottom of the vessel and is connected with movement control arm means projecting upwardly inside the vessel and having the top ends of the control arm means drivingly connected with driving means for imparting the reciprocal movement to the piston through said arm means.

8. A machine according to claim 4, characterized in that the vessel is a liquidfree treatment vessel, and that an air drying means is provided along the pile opener member, the outlet of the air drying means being directed to that part of the surface of the pile opener member carrying the opened pile of the mat.

9. A machine according to claim 4, wherein said mat contacting surface curvature is at least 3 foot$^{-1}$.

10. A machine according to claim 3, characterized in that the vessel is a liquidfree vessel preferably arranged as a pretreating unit in a row of mat treating vessels, and in which there is provided means for subjecting the opened pile to a flow of pressurized air, e.g. supplied in a pulsating manner, and means for sucking away the dust thereby released from the mat.

11. A machine according to claim 3, characterized in that there are provided more than one mat treatment vessel through which the mats successively are conveyed along the conveying path and that an upstream placed one of the liquid containing treatment vessels is supplied with liquid from a downstream placed treatment vessel, which liquid has been preheated, supplied with washing agent, rinsing agent and/or has been filtered before entering the upstream treatment vessel.

* * * * *